US007966752B2

(12) United States Patent
Grandin et al.

(10) Patent No.: US 7,966,752 B2
(45) Date of Patent: Jun. 28, 2011

(54) SPORTS SHOE FOR SPORTS INVOLVING A SLIDING MOVEMENT

(75) Inventors: Giorgio Grandin, Trevignano (IT); Sante Marinello, Volpago del Montello (IT)

(73) Assignee: Technica SpA, Treviso (IT)

( * ) Notice: Subject to any disclaimer, the term of this patent is extended or adjusted under 35 U.S.C. 154(b) by 819 days.

(21) Appl. No.: 11/987,236

(22) Filed: Nov. 28, 2007

(65) Prior Publication Data

US 2008/0120872 A1 May 29, 2008

(30) Foreign Application Priority Data

Nov. 28, 2006 (IT) ..... TV2006A0213

(51) Int. Cl.
*A43B 5/04* (2006.01)

(52) U.S. Cl. ..... 36/117.5; 36/117.3

(58) Field of Classification Search ..... 36/117.5, 36/117.3, 117.4, 27
See application file for complete search history.

(56) References Cited

U.S. PATENT DOCUMENTS 3,992,789 A * 11/1976 Dikoff ..... 36/117.3
4,026,045 A * 5/1977 Druss ..... 36/108
5,123,183 A * 6/1992 Paris et al. ..... 36/117.3
5,282,325 A * 2/1994 Beyl ..... 36/27
5,572,806 A * 11/1996 Osawa ..... 36/117.4

FOREIGN PATENT DOCUMENTS

EP 284070 A2 * 9/1988

* cited by examiner

*Primary Examiner* — Ted Kavanaugh
(74) *Attorney, Agent, or Firm* — Birch, Stewart, Kolasch & Birch, LLP

(57) ABSTRACT

A sport shoe to be used for sports involving a sliding movement, comprising a rigid shell inside which the foot is inserted; two pressure pieces, i.e. a heel piece and a toe piece, situated on the bottom of the shell and able to fix it to the bindings of sports equipment for performing a sliding movement. At least one pressure piece is movably connected to the shell so as to be able to move towards the shell in response to an external force causing them to move together.

25 Claims, 6 Drawing Sheets

SPORTS SHOE FOR SPORTS INVOLVING A SLIDING MOVEMENT

The present invention relates to a sports shoe for sports involving a sliding movement, in particular a ski boot.

During skiing (considered here by way of example and illustrated in FIG. 1 where 41 denotes a ski), or more generally sports involving a sliding movement, a boot 9 is connected to the piece of sliding equipment by means of fixing means which are commonly referred to as "bindings"—denoted by 21*a*, 31*a* (see FIG. 1)—inside which two shaped and projecting support-pieces 21*b*, 31*b*, i.e. a heel piece and a toe piece, integral with the boot 9, are engaged. It is by means of these support-pieces (similar to toeboards or "hoofs") that the boot 9, when the user is skiing, imparts a force to the ski 41. It is known that a skier, in order to perform a turn, must lean sideways onto the ski. The more he/she wishes to deform/curve the ski in order to perform a tighter turn, the more he/she must lean over and hence apply more effort and force.

This is even more so in the case of a carving ski 41*b* which has two concave sides 98*a*, 98*b* (see FIG. 2). In ideal conditions, namely without interference of the rigid sole of the boot which will be discussed below, a skier 97 (see FIG. 3A, 3B) in order to perform a certain turn, must lean over at a certain angle in order to curve the ski 41*b* through a corresponding radius of curvature R1 (see FIG. 3A, top). For a tighter turn (see FIG. 3B), the inclination must increase, in order to increase the radius of curvature—now R2—of the ski 41*b* (cf., the two skis, one in broken lines, in FIG. 3B, top). In fact a ski is ideally designed to flex depending on the load applied with a certain radius of curvature.

In real conditions, when performing a turn, the skis 41, 41*b* are deformed with a curvature which is similar to that indicated by C1 in FIG. 1. This curvature comprises a substantially flat central zone Z1, corresponding to the space between the two bindings 21*a*, 31*a*, connected in an almost horizontal manner to the adjacent portions 22*a*, 22*b* which form the ends of the ski 41. The rigid sole of the boot 9 and the bindings 21*a*, 31*a*, however, impose on the ski 41*a* curvature which is not ideal, owing to the straight section Z1.

This phenomenon, which prevents a uniform curvature of the skis 41 and 41*b*, results in an increase in the friction of the ski on the sliding surface, the generation of vibration transmitted from the snow to the skier and, in particular, an increase in the load to be applied owing to the non-uniform curvature. This means that, in order to perform a turn, which in ideal (uniform) curvature conditions would require less force, the skier is obliged to lean over and use a greater amount of force, in order to compensate for the smaller curvature of the ski for the same load.

Consequently, it is more difficult for the skier to operate the ski in order to correct and adjust the trajectories. Since the longer the straight section Z1 relative to the length of the ski the greater the deviation is from the ideal curvature, it is evident that the phenomenon described penalizes to a greater degree large-size ski boots, namely the majority of people who use them, as well as the sports which use short skis.

The main object of the invention is to provide a ski boot which overcomes this drawback of the known art.

This object, together with other objects, is achieved by a sports shoe to be used for sports involving a sliding movement, comprising a rigid shell inside which the user may insert his/her foot, and two support-pieces (SP), i.e. a heel piece and/or a toe piece, situated on the bottom of the shell and able to fix it to the bindings of sports equipment for performing a sliding movement, characterized in that at least one support-piece is movable with respect to the shell so as to be able to move towards the shell in response to an external force causing the at least one support-piece and the shell to approach (get nearer) each other.

In the case of a ski boot according to the invention, the mobility of the SP allows the ski to be deformed both in the zone situated underneath the boot and in the zone adjacent to the bindings and at the same time allows the shell to keep a rigid structure and the desired form. The form of the shell is not conditioned by the movement of the SP, thus leaving the skier's foot in a protected and comfortable position inside the boot, irrespective as to whether or not the skier is performing a turn or stressing the shell. It should be noted that the resistance of the sole to twisting, i.e. a stress which tends to twist the foot along its greater axis, is not negatively affected in anyway.

Advantageously, the mobility of the SP may be obtained by movably connecting it to the shell so that it is able to move towards the shell in response to an external force causing the at least one support-piece and the shell to approach each other.

The front end of the ski, from the binding to the tip, vibrates less, owing to the presence of a gentler curve in its central part (see section Z2 of the curve C2 shown in FIG. 1). Moreover, for the same central deformation imparted to the ski, in the case of uniform curvature (curve C2), the load to be applied is far less, requiring less effort from the skier.

The effect produced by the invention is very different from that described in the U.S. Pat. No. 6,446,363 which describes a ski boot with a flexible sole formed by two parts connected in a movable manner by means of resiliently deformable parts or hinges. The object in U.S. Pat. No. 6,446,363 is in fact to facilitate walking without skis. If on the one hand a flexible sole could allow the ski to be deformed also in the zone situated underneath the boot, on the other hand this means that the upper part must be also be made of a flexible material or structure, something which does not allow stable and safe position of the foot while skiing. In fact, a sole consisting of two parts which are rotatable relative to each other must be joined to an upper which is also flexible, otherwise the relative movement of the two parts would not be feasible. The skier, on the other hand, requires a rigid boot so that the foot, in addition to being protected from impacts, is substantially integral with the ski for greater control of the skiing movement.

The boot according to the invention may have the heel piece or the toe piece, or both parts, as a SP which is movable with respect to the shell. The choice also depends on the desired final characteristics.

The SP may be connected to the shell in different ways. For example by means of hinging (rotational displacement) or straight linear guides (linear displacement) or using both systems. Other types of articulation are, however, possible, these all falling within the scope of the invention. Each SP may have its own hinge or associated articulating system, or there could be a single hinge, or a single articulating system, in a central or off-centre (offset) position. In this case there could be an articulation which is common to the two SPs, for example a single rotational pin would control the two SPs. Advantageously limiting means able to limit the movement relative to the shell of the SP may be present, so that rotation and/displacement thereof is performed with a given and limited travel movement (stroke), thus controlling the response of the boot during skiing.

It is also possible to connect between the SP and the shell resilient means (or members) which are preferably pre-tensioned or preloaded (so as to expand, such as a compressed spring) and which allow the movement of the support-piece only when a considerable pressure greater than a threshold value is exerted between the foot and the ski, as in the case of a turn performed at high speed. In this way the shell is prevented from moving with respect to the ski as a result of forces which are less than the opposing force imparted by the resilient means (forces for example such as that corresponding to the simple weight of the skier). These same resilient parts also have the function of damping the vibrations between the ski and boot, ensuring a resilient return of the boot into the original configuration (depending on the elasticity constants of the resilient means arranged in between). The resilient means (or members) may also be designed so that all or some of them pass through the shell via holes formed therein and rest on a supporting insert (or scotch) of the inner shoe (inner sole), therefore forming a damping system, the force of which is partly transmitted directly onto the insert and hence onto the inner shoe and therefore onto the foot. In particular, the damping system could be composed of coil springs which press against the shell and elastomer "skewers" which work in parallel and abut against the insert through holes in the shell.

BRIEF DESCRIPTION OF THE DRAWINGS

The aspects and advantages of the present invention will emerge more clearly from the following description, provided purely by way of example, with reference to the accompanying drawings in which.

DETAILED DESCRIPTION OF THE INVENTION

Figure 4:
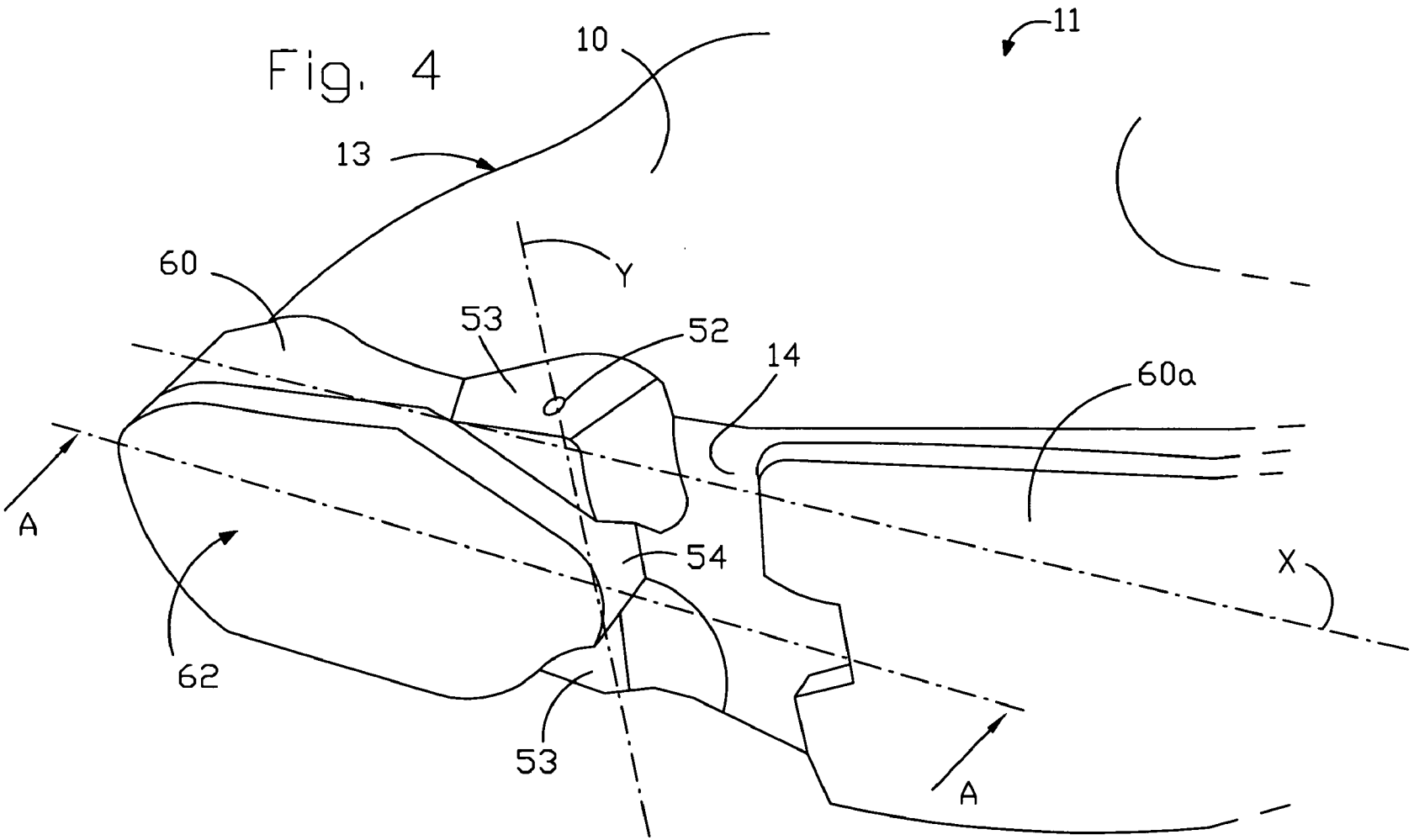
FIG. 4 is a partial three-dimensional view of a ski boot according to the invention.
Figure 5:
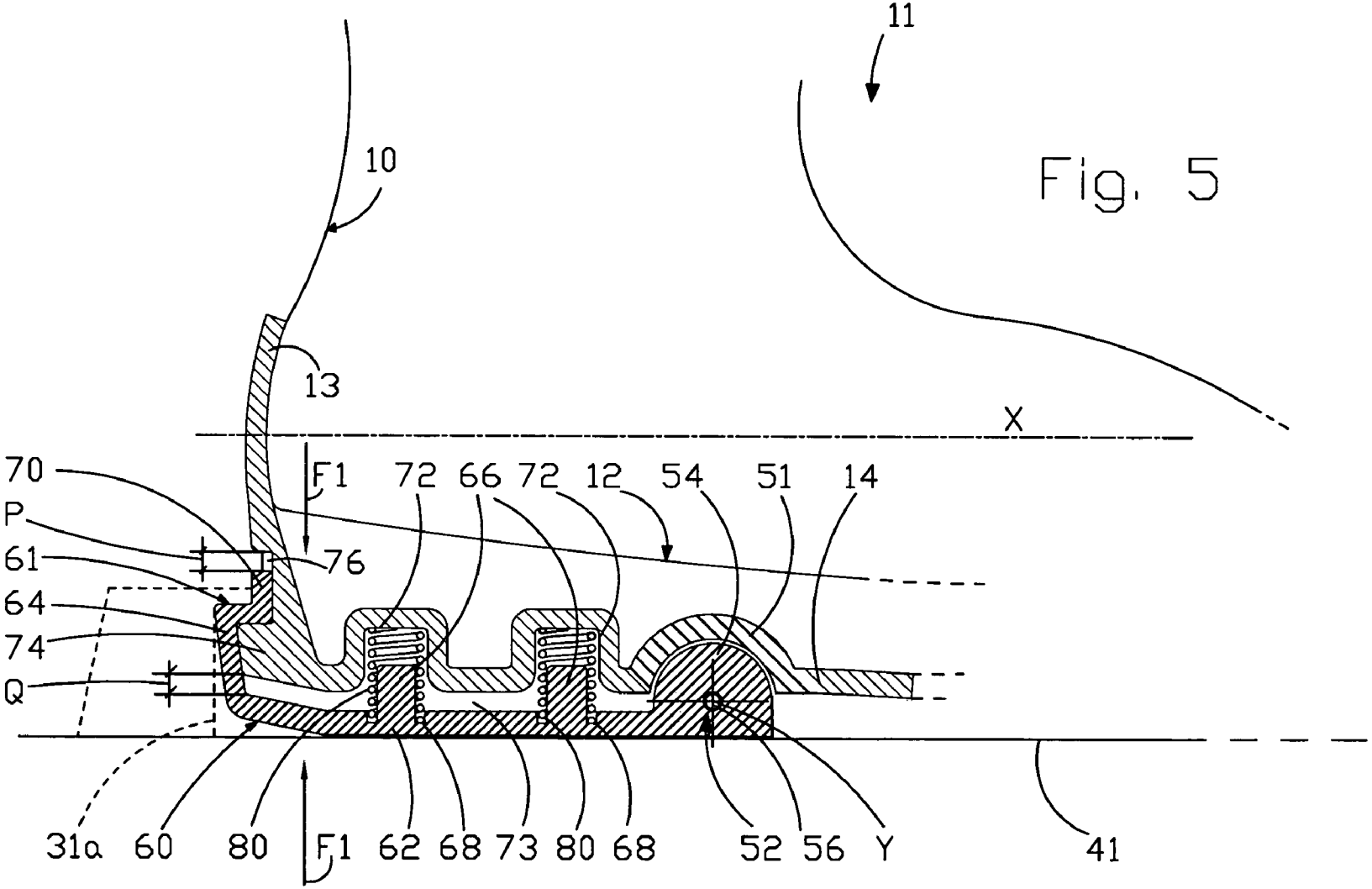
FIG. 5 is a longitudinally sectioned view of the rear part of the ski boot according to FIG. 4 along the cross-sectional plane A-A.

With reference to FIGS. 4 and 5, number 11 denotes a ski boot according to the invention resting on a ski 41. The ski boot 11 comprises a rigid shell 10 having an inner base 12 of an inner sole on which the foot rests, a rear wall 13 and a base bottom piece 14. A SP 60 is connected to the shell 10, said part being one of the two SPs, one in the heel piece and one in the toe piece 60*a* (only the first of which is shown in FIG. 5), by means of which the boot 11 is able to engage (in a known manner) inside the bindings 31*a*, 21*a* (or similar piece of sports equipment for performing a sliding movement).

The SP 60 has a flat bottom part 62 which extends at one end with a vertical formation comprising an inner undercut 64 (having an approximately C-shaped cross-section), while at the other end it is pointed and terminates in a rounded head 54 (approximately semi-cylindrical viewed in vertical section). Two identical pins 66 extend from the inner surface of the flat part 62 and their base is inset in the bottom 62 so as to form two identical circular seats 68. The undercut formation 64 terminates in a vertical segment 70 and defines outside the SP 60 a step 61 which is useful for engagement with the binding 31*a* of the ski 41. The SP 60 is connected to the shell 10 by means of hinging means (a hinging unit) operating about a horizontal hinging axis Y, approximately parallel to the sole of the shell 10 and perpendicular to the major longitudinal axis X of the shell 10 (as well as of the foot contained therein). The hinging means comprise the head 54 and two identical protrusions (or projecting teeth) 53 of the bottom 14 which are directed towards the ground. The protrusions 53 are situated along the sides of the head 54 and complement tapering thereof up to the profile of the sole of the bottom 14, i.e. the protrusions 53 have a form complementing the head 64 with respect to the bottom 14 of the shell 10.

Both the head 54 and the protrusions 53 have transverse through-holes 52 which pass through them along an axis Y perpendicular to the axis X. A pin 56 (or equivalent pivot means) is inserted inside the holes 52 and hinges together the head 54 and the protrusions 53. The bottom 14, on the surface facing the SP 60, also has:

(i) at the head 54, a concavity 51 complementary thereto and receiving its volume, while remaining slightly spaced therefrom (the concavity 51 allows the use of a larger head 54 so as to impart structural strength to the hinge, without increasing the distance of the SP 60 from the shell 10);

(ii) at the pins 66, blind holes 72, having a width slightly greater than the diameter of the pins 66. The position of the pins 66 and the holes 72 may also be inverted.

The rear end of the bottom 14 terminates in a projecting lip 74 which forms the base of the wall 13 and has dimensions slightly smaller than the volume surrounded by the undercut formation 64. An external groove 76, which has dimensions slightly greater than the vertical segment 70, is present above the lip 74.

The pins 66 are arranged facing, and partly penetrate inside, the holes 72, while the lip 74 is inserted inside the undercut 74 and the segment 70 is inserted inside the groove 76. Expanding resilient means 80 (springs in the example) are arranged between the SP 60 and the bottom 14 and keep the SP 60 at the maximum predefined distance from the shell 10 and produce a force which opposes an external force (see arrows F1) causing the SP 60 and the shell 10 to move towards and get near each other. The springs 80 are helical and have suitable dimensions so that they may be inserted without excessive play, on the one hand, inside the holes 72 and on the other hand, inside the seats 68, surrounding the pins 66. The holes 72 and the seats 68 have diameters corresponding to the springs 80. It can be noted that the groove 76 has an extension greater than the section 70 so as to provide a play P, while between the bottom 14 and the SP 60 there is an empty volume 73, so as to create angular play, of width Q, which is replicated (almost exactly) between the vertical dimensions of the undercut 64 and the lip 74. The lip 74 and the section 70 are slidably confined between the walls of the undercut 74 and the groove 76, respectively.

The overall design of the boot 11 is such that, with the application of an external force F1 tending to compress the shell 10 and the SP 60 together:

- the SP 60 pivoting on the pin 56 moves towards and approaches the bottom 14, rotating;
- the springs oppose this movement;
- the lip 74 slides inside the undercut 64, sweeping the play Q;

the section 70 slides inside the groove 76, sweeping the play P.

If the force F1 is greater than the opposing force of the springs 80, the SP 60 touches the bottom 14. It can be understood that both the lip 74 and the undercut 64 and the section 70 with the groove 76 form co-operating parts (a limiting unit) for limiting the maximum distance between the shell 10 and the SP 60, defined by the relative geometrical dimensions of these latter four parts. By varying these dimensions it is possible to vary the play Q and P and therefore the angular displacement of the SP 60 about the axis Y.

Figure 1:
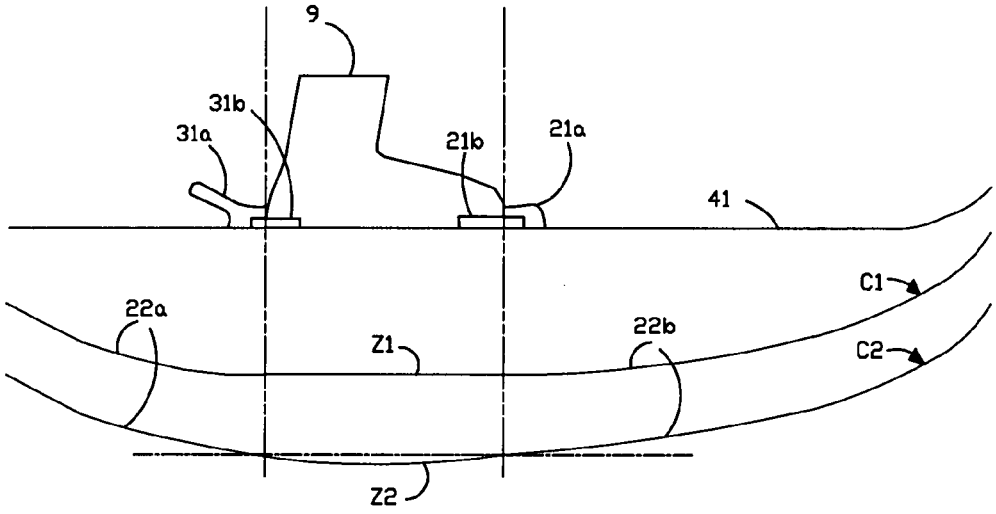
FIG. 1 is a schematic side view of a ski and a ski boot (above) and the deformation curves of the ski (below), i.e. curve C1 according to the known art, curve C2 according to the invention.

The rigidity of the springs 80 is such as to allow a rotation of the SP 60 only when the forces F1 involved exceed a limit value such as to deform the ski during a turn. In the case where no rotation is necessary, for example when the force applied onto the SP 60 corresponds only to the weight of the skier, the connection between the SP 60 and the shell 10 is substantially rigid. When the skier is performing a turn, he/she exerts a force F1 sufficient to compress the springs 80, producing a rotation of the SP 60 about the axis Y. Consequently, the ski, which is basically integral with the SP 60 via the bindings, is able to assume a curvature (see FIG. 1, curve C2, zone Z2) which begins underneath the shell, eliminating the straight section Z1 according to the known art (shown in the curve C2 as a broken line by way of comparison). The deformed curve of the ski in the vicinity of the bindings has a radius of curvature which is practically constant and not a horizontal tangent. The snow will therefore be acted on by a curve having a constant curvature (approximately an arc of a circle) and not alternating curved sections and straight sections, therefore minimizing the friction, the forces involved and the vibrations. Another advantage of the boot 11 is that it ensures the readiness of the bindings to open should the skier be catapulted away from the skis. In fact an external force in the opposite direction to F1 tending to raise the shell 10 from the ski 41 is instantaneously opposed by the lip 61 in the undercut 64 and causes opening of the binding 31*a* (or 21*a* in the case of the toe). Moreover the SPs according to the invention may be made of a material which is much harder and resistant to abrasion than the material which is generally used to produce a shell, and therefore may have a behaviour, with regard to wear and the resilient response of the connection with the bindings, which is superior to that of a normal ski boot. For example, the SP 60 may be made of metal, aluminium or magnesium alloys, or suitably reinforced plastics, polyurethane or fibre-reinforced nylon.

The number and the arrangement of the springs 80 may be different from those described, it being possible to use different resilient means such as leaf springs made of music wire, sandwiched arrangements of resilient materials of varying hardness, combinations of the abovementioned systems, or by interposing between the SP 60 and the bottom 14 a member made of resilient material (rubber or other) which allows a limited movement of the SP 60 and its return into the original position.

The invention may also be designed in a similar manner also (or only) for the toe-SP, so as to obtain a heel-SP and a toe-SP with two respective rotational/hinging axes. In any case, the ISO standards as regards heel and toe futures are under all circumstances complied with, resulting in another very notable advantage of the invention.

Other variants may in general be obtained by modifying the orientation and the position of the hinging axis, for example displacing it towards the ends of the bottom of the shell such that the SP (or both SPs) have pivoting ends (approximately) in the centre of the shell. The SP may also be mounted inside a special seat in the shell.

Figure 8:
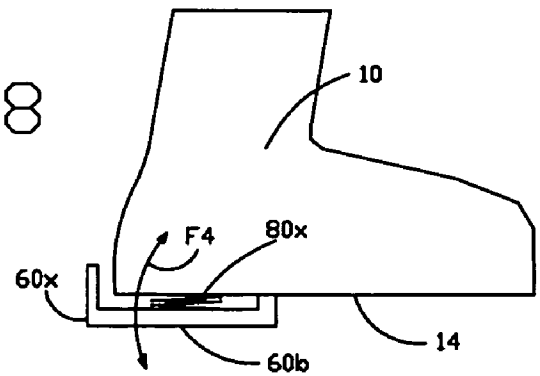
FIG. 8 shows a schematic side view of a ski boot according to a third variant of the invention.

The SP 60 could also have the head 54 directly fixed to the bottom 14 of the shell 60, for example by means of screws, or a SP 60*b*—see FIG. 8—could be a kind of tongue which extends integrally from the bottom 14; the important thing is that the free end 60*x* of the SP 60*b* may flex (arrow F4) so as to allow curvature of the ski as described. It is possible to provide resilient means 80*x*, having a structure and/or function similar to that already described, in the space between the SP 60*b* and the bottom 14.

Figure 6:
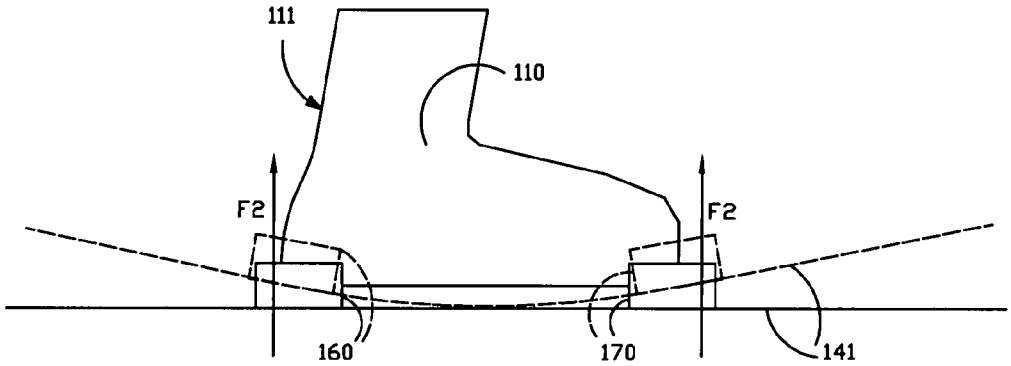
FIG. 6 is a schematic side view of a ski boot according to a first variant of the invention.
Figure 2:
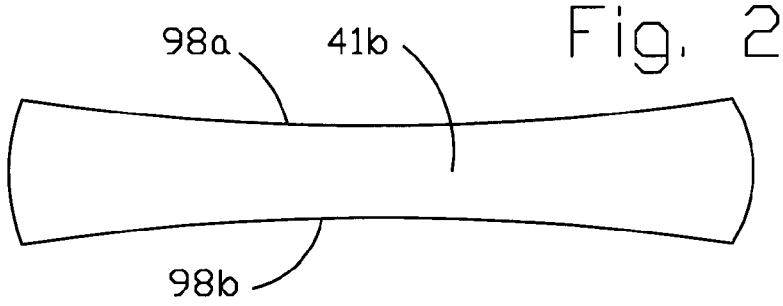
FIG. 2 is a plan view of a carving ski.
Figure 3A:
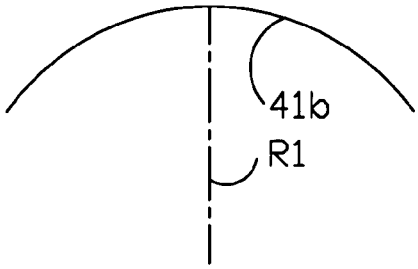
FIGS. 3A and 3B illustrate in schematic form the inclined position of a skier for turns with increasing curvature (at the bottom) and the associated curvature of the ski (at the top) viewed from the side.
Figure 3A:
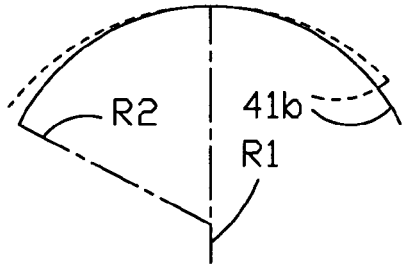
Figure 3A:
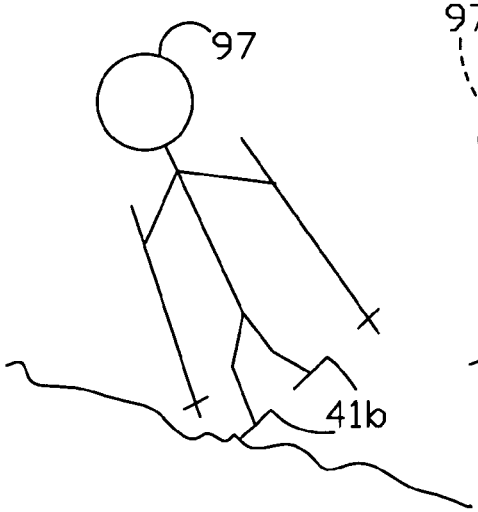
Figure 3B:
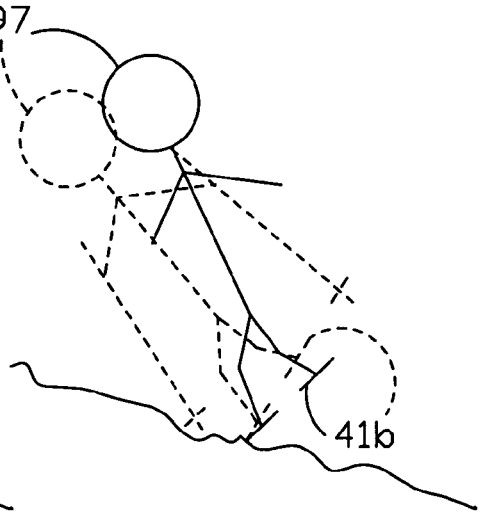

According to a first variant of the invention, which may be combined with the former and is shown schematically in FIG. 6, a boot 111 for a ski 141 comprises on a shell 110 a heel SP 160 and a toe SP 170 which can be connected to the said shell 110 by means of linear guides with mutual play (not shown). The guides allow a vertical displacement of the SPs 160, 170 (see arrow F2) and inclination thereof (owing to the slight play). This displacement is opposed by resilient means (not shown). In this way the SPs 160, 170, instead of rotating with respect to the shell by means of respective hinges, move vertically and incline slightly, varying their position with respect to the shell 110 (moving towards, and approaching, each other). The same comments made above with regard to the dimensions of the resilient means are applicable here and it is thus possible to obtain uniform flexing of the ski also below the ski boot 111. In this variant, therefore, linear guiding means, and not hinging means, are used.

Figure 7:
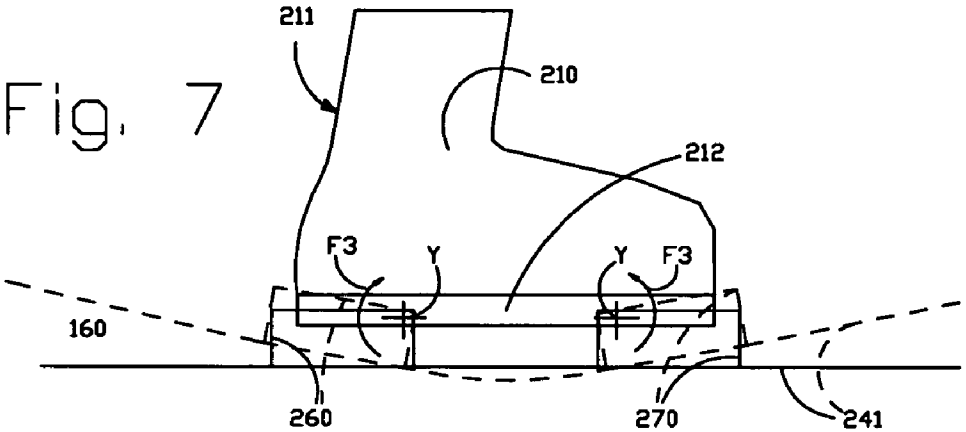
FIG. 7 shows a schematic side view of a ski boot according to a second variant of the invention.

According to another variant of the invention, shown in FIG. 7, a ski boot 211 for a ski 241 comprises on a shell a heel SP 260 and a toe SP 270. The SPs 260, 270 are, as above, rotatable about an axis Y with respect to the shell 210 (see direction F3 and parts shown in broken lines after rotation), but are movably mounted on a plate 212 fixed underneath the sole of the shell 210. Resilient means (not shown) are again arranged between the SPs 260, 270, as in the previous variants. In addition to the advantages already described, the use of a plate, preferably made of very rigid material, results in further advantages, including:

- near-perfect engagement between shell 210 and the SPs 260, 270 with greater freedom for design of the hinging means;
- the possibility of producing sets (kits) consisting of the sole+pivoting SP assembly for mounting on different shells, simply by applying the already finished sole+SP assembly to a shell, for example using screws, glue, etc. Thus the user may personalize his/her own boot, while the producer may offer in catalogue form a large number of models which have mutually interchangeable parts.

The same advantage of interchangeability is also obtained for the above variants, where it is possible to assemble/disassemble a SP on a shell by simply acting on the hinging or guide means (for example the pin 56 in FIG. 5).

Another advantageous, but optional feature is that of providing means for non-permanent blocking of a SP and the shell (or the plate). Thus the user is able to set up the boot according to the invention such that it has the SP or SPs movable with respect to the shell or not, consequently deciding whether to make use of the described action thereof during skiing. A simple design of the locking means (a locking unit) envisages two coaxial holes, one on the SP and one on the bottom of the shell. By inserting or not inserting a pin into the two coaxial holes it is possible to prevent the relative movement of the SP and the shell.

According to a further variant of the invention (not shown) it is possible to modify an in-line skate or ice skate, where its bottom frame is fastened to two pivoting parts of the upper shell.

Figure 9:
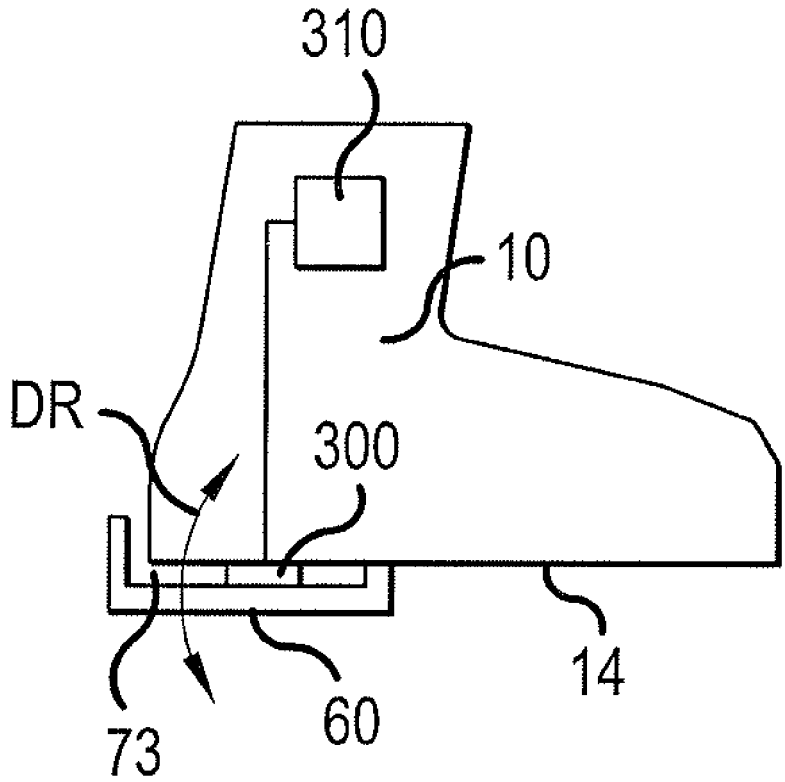
FIG. 9 shows a schematic side view of a ski boat according to a fourth variant of the invention.

As shown in FIG. 9, according to another variant is possible to insert into the empty volume between the SP and the bottom of the shell 10 (such as, for example, that indicated by 73 in FIGS. 5 and 9) mechanical (pneumatic or oil-hydraulic or magnetic) actuators 300 for servo-assisting and/or controlling the movement of the SP. An electronic control unit 310, which is suitably programmed and/or has a non-volatile memory, may be for example incorporated into the shell and interfaced with the skier by means of a keypad and display. It may control and/or program the actuators, defining the dynamic response DR thereof, and definitively establish the dynamic behaviour of the SP. As a result of all the above it is possible to program/control the dynamic behaviour of the ski, and the skiing movement, with the advantage of:

personalising the dynamic response of a ski;

correcting the errors in the turns performed by the skier;

storing and/or recalling dynamic response profiles of the ski boot.

Other functionally or conceptually equivalent modifications and variations are possible and may be envisaged while remaining within the scope of the invention as defined by the claims below.

The invention claimed is:

1. A sports shoe to be used for sports involving a sliding movement, comprising:

a rigid shell inside which the foot may be inserted;

at least one support piece rotatably movable with respect to the shell so as to be able to move towards the shell through a rotational displacement in response to an external force causing said at least one support-piece to move close to said shell; and a limiting unit configured to limit the rotational movement of said at least one support-piece relative to said shell when performing said sliding movement with said sports equipment, so that said rotational movement of said at least one support-piece occurs with a limited travel movement.

2. The shoe according to claim 1, wherein the at least one support-piece has one end integral with the bottom of the shell, with the other end free to flex.

3. The shoe according to claim 2, wherein the hinging unit includes, on the bottom of the shell, two protrusions between which one end of the at least one support-piece is rotatably engaged by a pivot unit.

4. The shoe according to claim 3, wherein the pivoted end of the at least one support-piece is tapered and the protrusions have a form complementary to the bottom of the shell.

5. The shoe according to claim 3, wherein the pivoted end of the at least one support-piece includes a flat bottom part which extends at one end with a vertical formation having an inner undercut having an approximately C-shaped cross-section, while at the other end it is pointed and terminates in a rounded head having an approximately, semi-cylindrical vertical cross-section.

6. The shoe according to claim 5, wherein pins extend from an inner surface of the flat part and have their base inset in the bottom so as to form circular seats, the pins being positioned opposite corresponding blind holes in the bottom of the shell which have a width slightly greater than the diameter of the pins and each pin supporting the end of a spring which is inserted with its other end into one of said blind holes.

7. The shoe according to claim 1, further comprising:

a hinging unit for mutual hinging the at least one support-piece and the shell.

8. The shoe according to claim 7, wherein the hinging unit has a hinging axis which is substantially parallel to a sole of the shell and perpendicular to the major longitudinal axis of the shell.

9. The shoe according to claim 8, wherein said hinging axis is arranged approximately in the centre of the bottom of the shell.

10. The shoe according to claim 1, further comprising:

a resilient member situated between the at least one support-piece and the bottom of the shell and adapted to allow the movement of the at least one support-piece only where a pressure greater than a threshold value is exerted between the two parts.

11. The shoe according to claim 10, wherein the resilient member is mounted so that all or part of the resilient member passes through the bottom of the shell by through-holes and abuts against an inner sole.

12. The shoe according to claim 1, wherein the limiting unit includes a projection present in the bottom of the shell and confined slidably between the walls of an undercut formation present in the at least one support-piece.

13. The shoe according to claim 1, wherein the limiting unit is formed by a projection of the at least one support-piece confined slidably between the walls of a groove formed externally in the shell.

14. The shoe according to claim 1, further comprising:

a resilient member situated between the at least one support-piece and the bottom of the shell and adapted to allow the movement of the at least one support-piece only in the case where a pressure greater than a threshold value is exerted between the two parts.

15. The shoe according to claim 14, wherein the resilient member is mounted so that all or some of the resilient member passes through the bottom of the shell by through-holes and abuts against an inner sole.

16. The shoe according to claim 1, further comprising:

a guiding unit for linear displacement with play between the at least one support-piece and the shell.

17. The shoe according to claim 1, further comprising:

a rigid plate fixed underneath the sole of the shell and on which the at least one support-piece is movably mounted.

18. The shoe according to claim 1, further comprising:

a locking unit for non-permanent locking of the at least one support-piece and the shell.

19. The shoe according to claim 18, wherein the locking unit includes two coaxial holes, one on the at least one support-piece and one on the shell, inside which a pin can be inserted so as to prevent the relative movement of the two parts.

20. The shoe according to claim 1, further comprising:

mechanical, pneumatic or oil-hydraulic or magnetic actuators provided in an empty volume between the at least one support-piece and the bottom of the shell.

21. The shoe according to claim 20, further comprising:

an electronic control unit programmed to drive the actuators so as to servo-assist and/or control the movement, relative the shell, of the at least one support-piece, defining the dynamic response thereof.

22. A parts kit, comprising:

an assembly of a sole and the at least one support-piece in accordance with claim 1, wherein the parts being suitable for being mounted on a shell.

23. A support piece suitable for mounting on a shell, comprising:

the at least one support-piece in accordance with claim 1.

24. A sports shoe, comprising:

a shell configured to be connected to the at least one support-piece in accordance with claim 23.

25. The shoe according to claim 1, wherein the at least one support-piece include at least one of a heel member and a toe member.

* * * * *